United States Patent [19]

Mitchell

[11] Patent Number: 4,622,813

[45] Date of Patent: Nov. 18, 1986

[54] STIRLING CYCLE ENGINE AND HEAT PUMP

[76] Inventor: Matthew P. Mitchell, 151 Alvarado Rd., Berkeley, Calif. 94705

[21] Appl. No.: 668,717

[22] PCT Filed: Oct. 29, 1984

[86] PCT No.: PCT/US84/01731

§ 371 Date: Oct. 29, 1984

§ 102(e) Date: Oct. 29, 1984

[87] PCT Pub. No.: WO85/01988

PCT Pub. Date: May 9, 1985

Related U.S. Application Data

[63] Continuation-in-part of Ser. No. 548,198, Nov. 2, 1983, abandoned.

[51] Int. Cl.[4] ..... F02G 1/04

[52] U.S. Cl. ..... 60/522; 60/526

[58] Field of Search ..... 60/517, 522, 526; 62/6

[56] References Cited

U.S. PATENT DOCUMENTS

| | | | |
|---|---|---|---|
| 2,560,987 | 7/1951 | Rinia et al. | 60/526 |
| 3,457,722 | 7/1969 | Bush | 60/522 |
| 4,241,580 | 12/1980 | Kitzner | 60/522 |

*Primary Examiner*—Stephen F. Husar

*Attorney, Agent, or Firm*—Karl A. Limbach

[57] ABSTRACT

Novel hot gas engines and heat pumps are provided which operate on an improved cycle related to the Stirling cycle. These hot gas engines and heat pumps use at least two separate heat exchanger assemblies and a plurality of valves to control fluid flow through the heat exchanger assemblies.

24 Claims, 6 Drawing Figures

STIRLING CYCLE ENGINE AND HEAT PUMP

RELATED APPLICATIONS

This application is a continuation-in-part of my copending application Ser. No. 06/548,198, filed Nov. 2, 1983, now abandoned.

TECHNICAL FIELD

The present invention is directed to novel forms of a hot gas engine and heat pump in which heat to be converted to work or to be pumped is applied external to cylinders containing the working gas. In particular, the present invention is directed to improved forms of a Stirling cycle engine and heat pump. The term "heat pump" is used in its generic sense designating a device which may be used either for heating or refrigeration.

BACKGROUND ART

The present invention is directed to a novel machine utilizing a modified "Stirling cycle". The first Stirling cycle machine was invented in 1816 by Robert Stirling. It ran as an engine, turning heat into mechanical energy. Subsequent development has shown that Stirling cycle machines can also be run in reverse, being driven by mechanical energy to act as heat pumps in refrigeration applications. Practical problems, discussed below, have prevented Stirling cycle machines from coming into widespread use in any of their potential applications.

Conventional Stirling cycle machines operate with working gas such as air, hydrogen or helium. When the Stirling cycle machine is run as an engine, the working gas is compressed while being cooled in the cold space of the engine during the "compression" phase of the cycle. The working gas is then permitted to expand into the hot space of the engine where it is heated as it expands during the power stroke phase of the cycle. The working gas is then transferred out of the hot space and into the cold space of the engine at constant volume during the "regeneration" phase of the cycle. The cycle then repeats.

The expansion of the working gas in the hot space of the Stirling cycle machine during the power stroke of the cycle produces work when the machine is run as an engine. The compression phase of the cycle absorbs work when the Stirling machine is run as an engine, but it absorbs less work than is generated in the expansion phase of the cycle. The excess work is absorbed in part by mechanical and gas friction (including that involved in the transfer/regeneration phase.) The remainder of the work is useful work.

When run as a heat pump, a Stirling cycle machine requires more energy to compress the working gas during the compression phase of the cycle than is returned during the expansion phase of the cycle because the part of the machine that is absorbing heat from the surroundings (i.e., the expansion space) is colder than the part of the machine where the working gas is compressed (i.e., the compression space).

The present invention is described below as an engine, with reference to the compression space as the "cold space" and the expansion space as the "hot space". If the machine were operated as a refrigerator (heat pump) rather than as an engine, temperatures of the compression and expansion space would be reversed. Both when the invention is used as an engine and as a heat pump, gas entering the expansion space is subjected to external heating, and gas entering the compression space is subjected to external cooling.

Numerous machines embodying variants of the Stirling cycle have been described. (See Walker, Stirling Engines, Claredon Press (1980); Stirling Engine Design and Feasibility for Automotive Use, Collie ed., (Noyes Data Corp. 1979).

The theoretical advantages of the Stirling cycle engines are considerable. They are, in theory, highly efficient. Also, since their heat sources are external to the working gas, some of the air pollution problems associated with internal combustion engines can be avoided. Since fuel for a Stirling cycle engine can be burned steadily at atmospheric pressure rather than exploded at high temperature and pressure, Stirling cycle engines are comparatively quiet. They may be powered by any available source of heat and can thus operate with any type of fuel, including solar heat, geothermal heat or heat from nuclear fission or fusion.

However, a number of practical problems have prevented commercial use of Stirling cycle machines. Those problems include the following:

(1) The mechanical movement necessary to accomplish the cycle (i.e., reduce the volume of the working gas in the cold space, then increase the volume of the working gas in the hot space, then simultaneously reduce the volume of the working gas in the hot space and increase the volume of the working in the cold space) has required complex and expensive arrangements of gears and levers, or the use of multiple cylinders entailing significant weight and friction losses.

(2) Energy loss through friction of the working gas has been a major problem in Stirling cycle machines. Modern Stirling machines heat and cool the working gas by passing it through hot and cold tubes located, respectively, on either side of a regenerator. The use of multiple tubes increases the surface area available for heat transfer relative to a single, large diameter tube, but also greatly increases gas friction. Stirling engines normally employ a "regenerator" of knitted wire, wire mesh, or some similar material between the sets of hot and cold tubes. The regenerator functions by absorbing heat from the gas at one time and returning the heat to the gas at a later time. The regenerator also produces substantial gas friction as the working gas passes back and forth through it, dissipating energy.

(3) The conventional arrangement also creates a thermodynamic problem in that the working gas is passed through the hot heat-exchanger at times during the cycle when it would be desirable for the working gas to be cooled and through the cold heat exchanger at times when it would be desirable for the working gas to be heated.

The present invention accomplishes improvements in all of these areas, producing an efficient thermodynamic cycle with mechanical apparatus employing simple harmonic motion with reduced gas friction.

In one aspect of the invention, improvements in Stirling engine type devices are obtained by employing two separate volumes of gas which are expanded and compressed through Stirling type cycles, sequentially sharing expansion and compression chambers with one volume undergoing expansion while the other undergoes compression.

In another aspect of the invention, gas enters and exits the expansion space of the engine through different ports and a regenerator at the entrance port retains heat of compression and may permit superheating of the working gas in the regenerator.

It is an object of the present invention to provide improved high power, high speed, modified Stirling cycle engines.

It is another object of the present invention to provide improved heat pumps operating in a modified Stirling cycle.

It is a further object of the present invention to provide a low pressure, low speed, modified Stirling cycle engine operative by low quality heat sources such as solar energy.

Other objects will be apparent from the following description.

BEST MODE FOR CARRYING OUT THE INVENTION

The present invention provides an engine employing at least one cylinder, sealed at both ends, fitted with a double-acting piston, and with two or more heat-exchanger assemblies connecting one end of the cylinder to the other end of the cylinder. Each heat exchanger assembly contains at least a heater, a cooler, and a valve at each end where it opens into one or the other end of the cylinder. Each heat exchanger may also contain one or more regenerators and/or one or more bypasses and bypass valves.

By operation of the above-mentioned valves, each heat exchanger assembly participates in a thermodynamic cycle, sharing, in its turn, the assistance of the piston for the movement of gas. As will become apparent, the cycles accomplished by all of the heat exchanger assemblies are identical, but interlocked in time sequence. The theoretical operation of the cycle in each heat exchanger assembly may be as follows:

Stroke 1 (Compression): The working gas is expelled from the compression space of the cylinder into the heat exchanger assembly and thereby compressed from its lowest pressure level during the cycle to a higher level, being cooled as it passes through the cooler during this stroke to minimize the work required to compress it;

Stroke 2 (Isolation): The working gas is confined in the heat exchanger assembly in its compressed state, with no change in volume, and no input or output of mechanical work.

Stroke 3 (Expansion): The working gas is expanded out of the heat exchanger assembly into the expansion space of the cylinder, dropping from its highest pressure to an intermediate pressure, while being heated during this stroke to minimize the pressure drop and maximize the work done, and;

Stroke 4 (Regeneration): The working gas is moved, with no change in volume, out of the expansion space of the cylinder, through the heat exchanger assembly and into the compression space of the cylinder with no significant input or output of mechanical work, so that it can be compressed again, repeating stroke 1. During this "regeneration" stroke, the working gas is cooled so that its pressure reaches the lowest point in the cycle at the beginning of the compression stroke, thereby reducing the amount of work required to compress the working gas during stroke 1.

Figure 1:
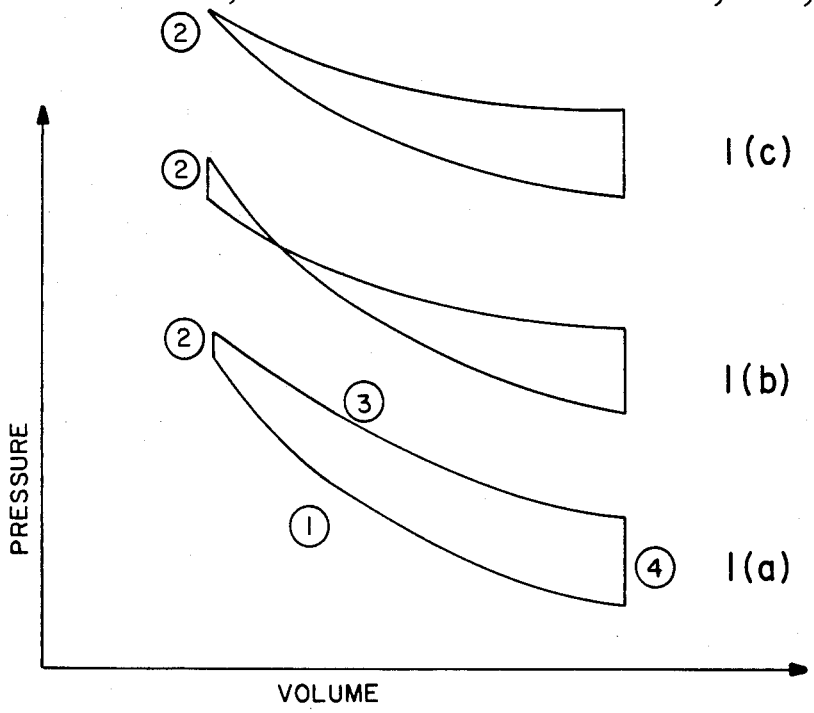
FIGS. 1(*a*), 1(*b*) and 1(*c*) illustrate the pressure changes of the working gas in an engine according to the present invention.

These pressure changes may be illustrated graphically as shown in FIG. 1(*a*). This theoretical illustration of the local pressure of the gas is dependent upon heat transfer rates between gas and the surface of the heat exchangers. Gas trapped in the heat exchanger assembly during the isolation stroke would heat up or cool down depending upon the temperature of the adjacent surface. Gas in the cooler would cool. Gas in the heater would adjust its temperature in both directions; gas entering the heater during the preceding (compression) stroke would be cooler than the adjacent heat exchange surface but gas at the far, closed end of the heater would be compressed and would actually be hotter than the adjacent heater surface.

In some cases the rising temperature caused by compression of hot gas that was in the heater at the beginning of the compression stroke more than outweighs the low temperature of gas entering the heater from the cooler (or from the optional regenerator) during compression. That would cause FIG. 1 to look like two triangles, apex to apex, as shown in FIG. 1(*b*).

Conceivably, the temperature rise and drop could cancel out perfectly. That would produce the triangle-shaped P/V diagram of FIG. 1(*c*) which also results theoretically from perfect, instantaneous heat transfer. Thus, depending upon whether average gas temperature in the heater (and, for that matter, the regenerator and cooler) rises, falls, or stays the same during the isolation stroke, the P/V diagram in FIG. 1 could look like 1(*a*), 1(*b*), or 1(*c*). It is conceivable that the same engine, running at different temperature differentials and/or different operating speeds might at times reflect each of these three P/V diagrams.

Referring to FIG. 1, the area under the compression curve (stroke 1) is less than the area under the expansion curve (stroke 3), and the difference is the mechanical work output of the engine.

Figure 2:
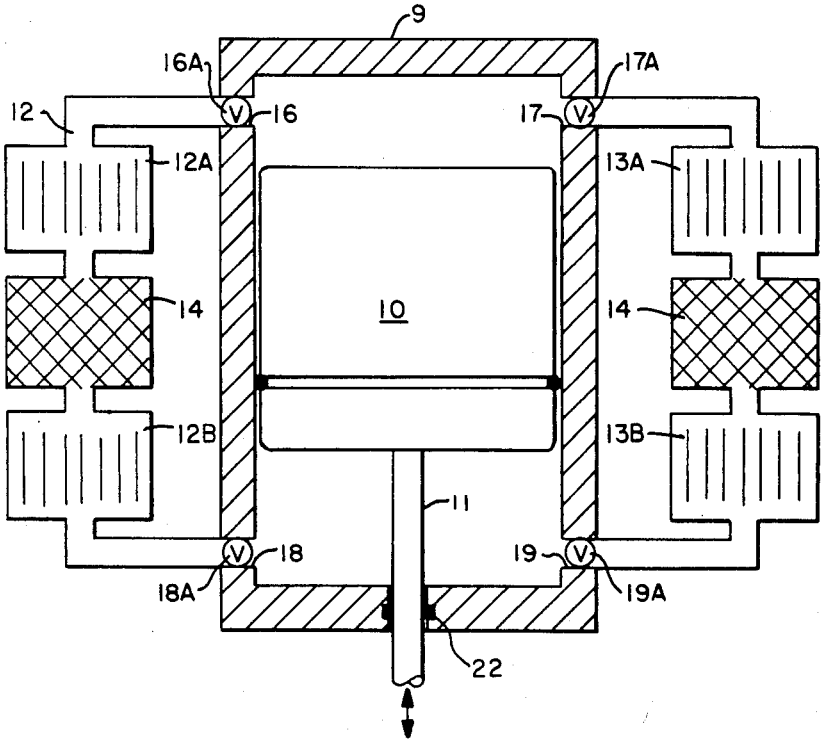
FIG. 2 illustrates a basic arrangement of the invention.

An elemental embodiment of the invention is shown schematically in FIG. 2. A double acting piston 10 travels within an enclosed cylinder 9. The piston is connected to a piston rod 11. The piston rod 11 is in turn supported against lateral movement by a crosshead (not shown). The piston rod 11 connects through a conventional connecting rod 11*a* to a crankshaft 11*c*, the mass of which taken by itself or with an auxiliary means, such as a conventional flywheel 11*b*, provides means for storing kinetic energy of the piston during one phase of a reciprocating cycle and returning the energy to the piston during another phase of the reciprocating cycle. The piston rod passes through a seal 22.

One end of the cylinder 9 is connected to the other end of the cylinder through heat exchanger assemblies 12 and 13, consisting of, in each instance, a heater (12A, 13A) and a cooler (12B, 13B). The heat exchanger assemblies communicate into the expansion space of the cylinder through ports 16, 17 and into the compression space of the cylinder through other ports 18, 19. Between each port 16, 17 into the expansion space and its associated heater 12A, 13A is a valve (16A, 17A). Between each port into the compression space and its associated cooler 12B, 13B is a valve 18A, 19A. Regenerators 14 located between each heater and cooler are optional.

As the piston 10 travels back and forth between the expansion end of the cylinder and the compression end of the cylinder, the valves 16A, 17A, 18A, 19A open and close in this sequence:

| | VALVES | | | |
|---|---|---|---|---|
| Piston Position | 16A | 17A | 18A | 19A |
| Moving towards compression end | Closed | Open | Open | Closed |
| At compression end | Closed | Open | Closes | Opens |
| Moving toward expansion end | Closed | Open | Closed | Open |
| At expansion end | Opens | Closes | Closed | Open |
| Moving toward compression end | Open | Closed | Closed | Open |
| At compression end | Open | Closed | Opens | Closes |
| Moving toward expansion end | Open | Closed | Open | Closed |
| At expansion end | Closes | Opens | Open | Closed |

The cycle then repeats. It should be observed that (disregarding leakage, and small quantities of residual gas not swept from the cylinder) the quantity of working gas that passes through valves 16A and 18A is at all times separated from the quantity of gas that passes through valves 17A and 19A.

If the pressure/volume relationships of the quantity of working gas that passes back and forth through each heat exchanger assembly are considered separately, it can be seen that each such quantity of working gas conforms to the pressure/volume diagram of FIG. 1 during the course of the cycle, but that the pressure/-volume relationships of the two quantities of gas are 180° out of phase with respect to each other throughout the cycle.

Figure 3:
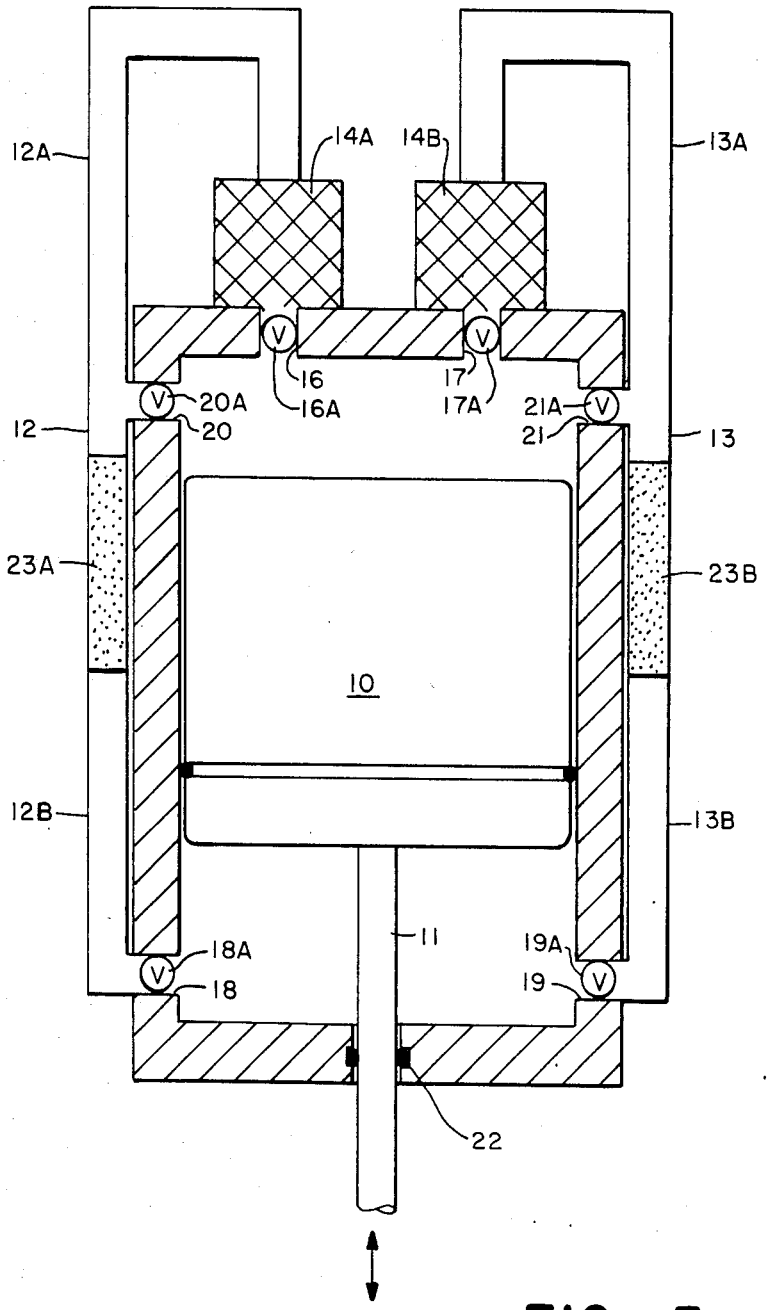
FIG. 3 illustrates an embodiment of a single cylinder engine according to the present invention, employing dual regenerators and by-pass.

A preferred embodiment of an engine is shown in FIG. 3. A double-acting piston 10 travels within an enclosed cylinder. The piston is connected to a piston rod 11. The piston rod 11 is in turn connected to a conventional connecting rod (not shown) which connects to a crankpin and crankshaft (not shown), and is preferably supported against lateral motion by a conventional cross-head (also not shown).

Referring to FIG. 3 there are two heat exchanger assemblies 12 and 13 consisting of a cooler 12B, 13B, a heater 12A, 13A and a regenerator 14A, 14B, connected in series. The regenerator end of each heat exchanger assembly is connected to the hot end of the cylinder through valved ports 16 and 17, accommodating valve means 16A and 17A, respectively. The other end of each heat exchanger assembly is connected to the compression valve cylinder ports 18 and 19 accommodating valve means 18A and 19A, respectively. Bypass ports 20 and 21 accommodating valve means 20A and 21A, respectively, are provided, connecting the expansion space of the cylinder to each heater exchanger assembly 12, 13, between the cooler 12B, 13B and the heater 12A, 13A. A second pair of regenerators 23A and 23B may be provided between the valves 20A and 21A and the cooling sections 12B and 13B.

In this embodiment, working gas flows through the heat exchanger assemblies into the expansion space through valves 16A and 17A, but flows out of the expansion space into the heat exchanger assemblies through valves 20A and 20B. As a result, the valving sequence is as follows:

| | VALVES | | | | | |
|---|---|---|---|---|---|---|
| Piston Position | 16A | 17A | 18A | 19A | 20A | 21A |
| Moving toward compression end | Closed | Open | Open | Closed | Closed | Closed |
| At compression end | Closed | Closes | Closes | Opens | Closed | Opens |
| Moving toward expansion end | Closed | Closed | Closed | Open | Closed | Open |
| At expansion end | Opens | Closed | Closed | Open | Closed | Closes |
| Moving toward compression end | Open | Closed | Closed | Open | Closed | Closed |
| At compression end | Closes | Closed | Opens | Closes | Opens | Closed |
| Moving toward expansion end | Closed | Closed | Open | Closed | Open | Closed |
| At expansion end | Closed | Opens | Open | Closed | Closes | Closed |

The effect of this sequence is that, in the course of one cycle, the working gas flows through the cooler twice (once in each direction) but flows through the heater and regenerator only once, (in one direction). By contrast, in a conventional Stirling cycle engine, the working gas passes through heater, cooler and the regenerator in both directions during each cycle. The present invention thus eliminates some of the gas friction that occurs in the traditional Stirling cycle engine. Moreover, to the extent that there is gas friction resulting from passage of the gas through the regenerator, it is turned into heat, which is then transferred into expansion space rather than into the cooler.

The heaters 12A, 13A are heated by heating means (not shown), such as a combustor, solar energy, and the like. The coolers 12B, 13B are cooled by water jackets, air, or other suitable heat sink.

The cycle of an engine according to the present invention differs from the traditional Stirling cycle in that much higher compression ratios are possible. Since an entire volume of working gas is swept into a heat exchanger assembly and locked there under compression by the valves at each end, the ratio of the swept volume of the cylinder to the volume of the heat exchanger assembly determines the compression ratio. By using a relatively small volume in the heat exchanger assembly high compression may be obtained.

The high compression attainable with the present engine is desirable in that it permits the engine to generate great power relative to its size. However, the high compression ratio carries with it a penalty in the form of very high pressures in the machine at the conclusion of the compression stroke. This high pressure tends to raise the temperature of the working gas as the compression stroke progresses, increasing the amount of work consumed in compressing the working gas.

To mitigate this effect, each heat exchanger assembly is arranged to limit the compression heating of the working gas.

This is accomplished by arranging each heat exchanger assembly so that cold gas from the cold heat exchanger (or center regenerator, if any) is not immediately warmed as it enters the heater, such as, by using heater tubes substantially larger in diameter than those that would be used in a conventional Stirling cycle machine, or even a single heater tube. By thus reducing the heat exchange area of the heater, the heating process may be delayed.

By contrast, the regenerator and cooler tubes may be designed for rapid heat transfer so that gas entering either will assume the temperature of the regenerator or cooler tubes almost immediately.

The heater may have heat transfer characteristics such that the gas that is in the heater (12A, 13A) at the beginning of the compression stroke will have approached the temperature of the heater tube by the time that compression begins. Referring to FIG. 3, as the compression stroke progresses, that hot gas will be progressively forced towards the expansion valve (16A or 17A), and, through compression, further heated. To mitigate that effect, the expansion end regenerators (14A, 14B) are interposed between the heater and the ports into the expansion space so that heat from gas that is forced out of the heaters into the expansion end regenerators will be absorbed by the regenerators and the temperature rise will be mitigated. With sufficient thermal mass of the regenerators, minimal temperature rise will occur in the regenerator during any single cycle. However, over a number of cycles, and if the working gas passes through a bypass (20, 21) during the exchange stroke, it is possible to raise the temperature of the expansion end regenerator above the temperature of the heater, thereby increasing the pressure of the working gas during the expansion stroke and improving the engine's performance. This effect depends upon the volumes in the heat exchanger assembly's components, compression ratio of the engine, the temperature of gas entering the heater during the compression stroke, and the rate of heat transfer in the heater and can be calculated by nodal analysis methods known to the art.

By appropriately sizing the regenerators, heater tubes and cooler tubes relative to the swept volume of the cylinder, substantially all of the gas in the heater tube at the beginning of the compression stroke will be forced into the expansion end regenerator by the end of that stroke, with the result that, during the course of the stroke, all of the volume of the heater tube will be filled with gas that has just passed through the cooler or center regenerator.

Then, when the hot valve (16A or 17A) opens at the beginning of an expansion stroke, gas will be heated to expansion end regenerator temperature as it expands into the expansion space in the cylinder. The temperature of that gas will, at least initially, exceed heater temperature. While the gas in the heater will drop in temperature as the expansion stroke progresses, it must pass through the expansion end regenerator on its way into the cylinder and will be heated in that process to a temperature close to or even above maximum heater tube temperature.

A bypass arrangement similar to that shown for the expansion end may be incorporated into the compression end. If that is done, working gas should enter the compression space through the coolers 12B, 13B, but leave the compression space through bypasses communicating directly with the center-mounted regenerators 23A, 23B.

During the isolation phase, all of the valves in the isolated heat exchanger assembly experience positive pressure from within the heat exchanger assembly. However, when an expansion valve (16A or 17A) opens and working gas enters the expansion space of the cylinder, pressure in the cylinder will exceed that in the heat exchanger assembly in which compression is just beginning to occur. Thus there will be a pressure differential between the expansion end of the cylinder and the heat exchanger assembly into which working gas is being compressed so long as the pressure in the expansion space exceeds the pressure in the compression space. Eventually, however, as the piston continues its movement, the pressure in the expansion space will drop and the pressure on the expansion valve of the heat exchanger assembly into which gas is being compressed will reverse directions.

Figure 4A:
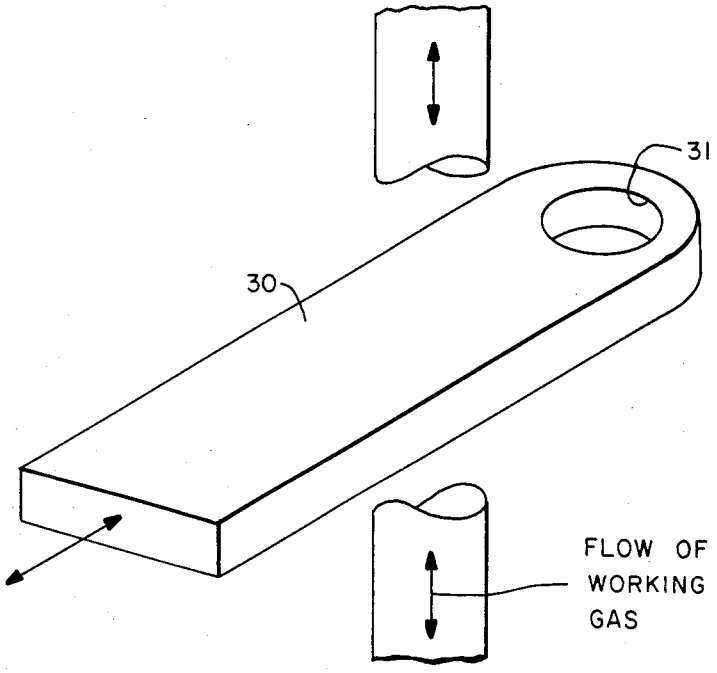
FIG. 4A illustrates a perspective view of a gate valve usable with the engine of FIG. 3.
Figure 4B:
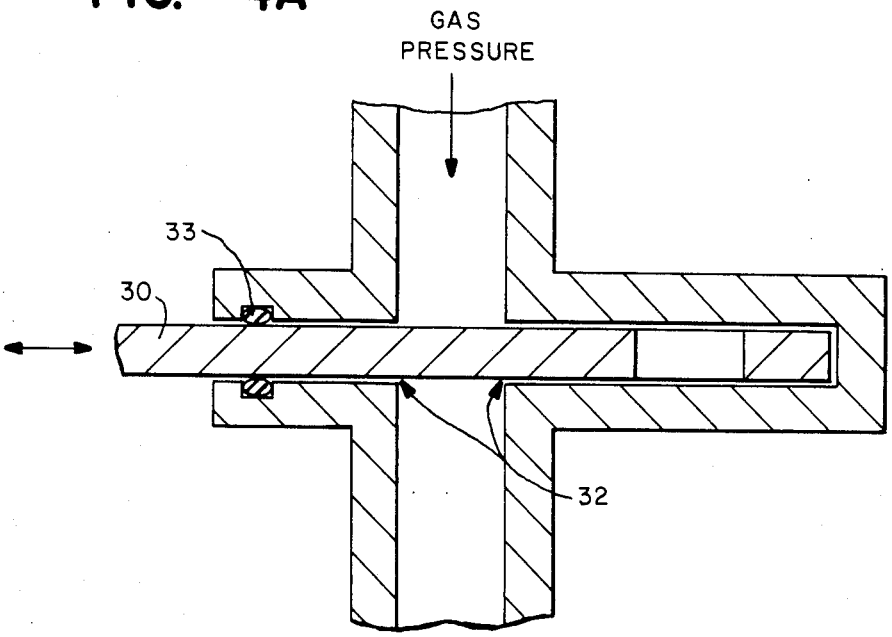
FIG. 4B illustrates a cross-section of a gate valve usable with the engine of FIG. 3.

In order to deal with this problem, the valves in direct communication with the expansion space of a high pressure version of the engine will be pressure-sealing in both directions. For applications such as heat pump applications in which temperatures are relatively low and lubricants may be used, a simple gate valve (FIGS. 4A and 4B) may be used. In such a valve, the gate 30 intersects the flow of working gas. In the open position, a hole 31 in the gate lines up with the path of flow, and the gas flows unimpeded. When the gate is closed, a flat plate cuts off the gas flow. Referring to FIG. 4B, if both sides of the gate are suitably smooth and the ends of the opening through which the working gas passes can be ground to a smooth valve seat, then the gate will press first against one side and then the other side of its slot as gas pressure reverses. It thus forms a pressure seal 32 in either direction. A suitable sealing means 33 further seals the gate 30 surfaces from leakage. Hermetically sealed, solenoid operated valves may also be used.

Figure 4C:
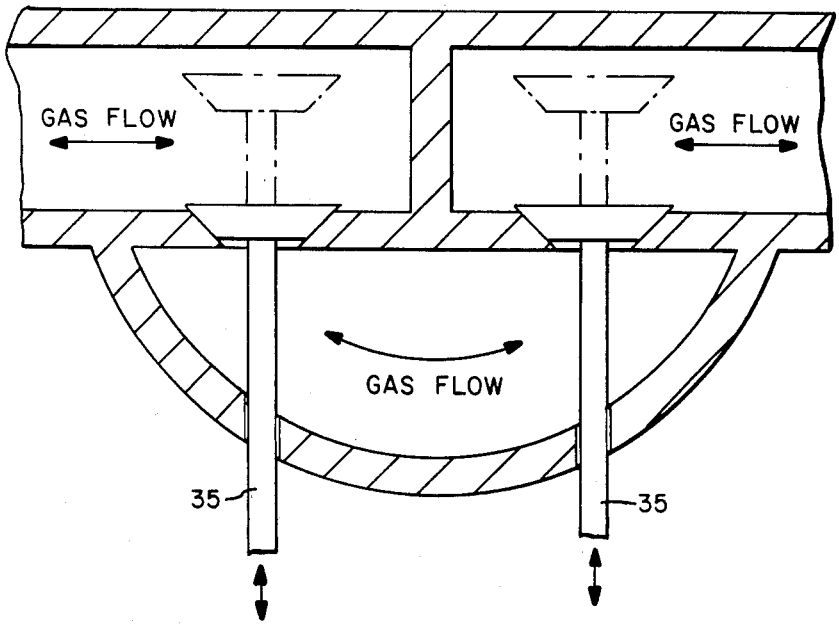
FIG. 4C illustrates a poppet valve assembly usable with the engine of FIG. 3.

For high temperature application, double poppet valves 35 (FIG. 4C) may be used. Other arrangements known in the valve pressure-sealing are will be obvious to those of ordinary skill.

In embodiments of the present invention that employ a piston and crankshaft arrangement, timing of valve movements may be synchronized to piston movements by conventional mechanical, electrical or electronic means that sense crankshaft position.

More than two heat exchanger assemblies ("tube sets") may be used. There are at least two practical advantages from the use of a relatively large number of tubesets. These advantages arise from the fact that during the exchange stroke, only one tubeset is actively receiving and discharging gas. During the power/compression stroke, only two tubesets are receiving or discharging gas. The remaining tubesets are locked in the "isolation" phase, allowing time for heat transfer to occur and temperature adjustments to be made. Thus, there is no necessity for extremely rapid transfer of heat from the heater to the gas enclosed within it. Ideally, cold gas entering the heater during compression does not warm significantly by conduction and convection from the heater walls until after the compression is complete and a valve has locked the working gas into the heat exchanger assembly.

Because this design will tolerate relatively slow heat transfer between the heater tubes and the working gas, fabrication of the heater may be greatly simplified. In the extreme, a single heater tube may be used, greatly facilitating fabrication.

Another advantage of a single heater tube (or a small number of relatively large diameter heater tubes) is the substantial reduction of gas friction drag that can be accomplished.

For optimum operation, machines according to the present invention should be balanced, i.e., the volumes of working gas associated with the heat exchanger assemblies should be essentially equal. Most practical machines will be self-balancing, while running, due to the inability of the piston to completely scavenge the cylinder and valve ports. A small quantity of gas will remain in the compression space and in the compression space valve ports at the end of each power/compression stroke. If the heat exchanger assembly into which gas has just been compressed contains a disproportionately large quantity of gas, the residual quantity of gas in the compression space and compression space valve ports will also be disproportionately large. Thus, at the end of the compression stroke, as the compression space valve closes on the newly-compressed gas and another compression space valve opens for the exchange stroke, an extra increment of gas will be transferred to the next heat exchanger assembly that is about to experience the exchange stroke, increasing slightly the quantity of gas in that heat exchanger assembly. In this way, as the engine cycles, small quantities of gas are automatically redistributed from heat exchanger assemblies that contain excess gas to those that contain lesser amounts and the balance is thus maintained.

Balancing the machine as an engine, when the engine is to be started after it has been left in a condition such that working gas has leaked through valves or otherwise redistributed itself, may be achieved by a starting mechanism. Thus, it may be necessary to crank the engine until approximate balance is achieved. If the engine is already balanced when it is to be started, it may need only be cranked through one cycle to start.

What is claimed is:

1. A method of operating a hot gas engine comprising a cylinder having one end thereof connected to the other end thereof through at least two separate closed heat exchanger assemblies, each comprising heated heat exchanger means and cooled heat exchanger means serially arranged, the hot end of each such closed heat exchanger assembly being attached to the same end of the cylinder; each said closed heat exchanger assembly equipped with valve means at each end thereof; said cylinder accommodating a double-acting reciprocating piston means; said piston means cyclically displacing and being displaced by a volume of gas for each such closed heat exchanger assembly; said volumes of gas being alternately confined in and released from said closed heat exchanger assemblies by said valves, comprising steps of:

(a) with said piston essentially at the end of its travel toward the end of said cylinder communicating through valve means to the heated heat exchanger means, with both valve means in the first heat exchanger assembly in open position and both valve means in the second heat exchanger assembly in closed position and with a first volume of gas disposed within said first heat exchanger assembly and within said cylinder, and with a second volume of gas compressed in said second heat exchanger assembly and with each other heat exchanger assembly containing a volume of gas compressed within it, closing said valve means at the hot end of said first heat exchanger assembly and essentially simultaneously opening said valve means at the hot end of said second heat exchanger assembly, expanding said second volume of gas into said cylinder against the first side of said piston while simultaneously compressing and expelling from said cylinder on the second side of said piston said first volume of gas through valve means at the cold end of said first heat exchanger assembly into said first heat exchanger assembly;

(b) with said piston essentially at the end of its travel toward the end of said cylinder communicating through said valve means to the cold ends of said heat exchanger assemblies, closing said valve means at the cold end of said first heat exchanger assembly and essentially simultaneously opening said valve means at the cold end of said second heat exchanger assembly, expelling said second volume of gas from said cylinder on said first side of said piston through said second heat exchanger assembly into said cylinder on said second side of said piston while simultaneously retaining said first volume of gas compressed in said second heat exchanger assembly;

(c) with said piston essentially at the end of its travel toward the end of said cylinder communicating with said valve means to the hot end of said heat exchanger assembly, closing said valve means at the hot end of said second heat exchanger assembly and essentially simultaneously opening said valve means at said hot end of another heat exchanger assembly, which, in the case of an engine equipped with only two heat exchanger assemblies will be said first heat exchanger assembly, expanding said other volume of gas into said cylinder through said valve at the hot end of said other heat exchanger assembly against the first side of said piston while simultaneously compressing and expelling from said cylinder on the second side of said piston said second volume of gas through said valve means at the cold end of said second heat exchanger assembly into said second heat exchanger assembly;

(d) with said piston essentially at the end of its travel toward the end of said cylinder communicating with said valve means to the cold end of said heat exchanger assembly, closing said valve means at said cold end of said second heat exchanger assembly and essentially simultaneously opening said valve means at the cold end of said other heat exchanger assembly, expelling said other volume of gas from said cylinder on said first side of said piston through said other heat exchanger assembly into said cylinder on said second side of said piston while simultaneously retaining said second volume of gas compressed in said second heat exchanger assembly;

(e) repeating the cycle described in steps c. and d., treating the heat exchanger assembly from which gas has most recently been expelled into the cylinder as the second heat exchanger assembly and the next heat exchanger assembly in sequence as the other heat exchanger in a continuous repetition.

2. A method according to claim 1 wherein regenerator means are serially interposed between the heated heat exchanger means and the cooled heat exchanger means in each of said heat exchanger assemblies.

3. A method according to claim 1 wherein regenerator means are serially interposed between said heated heat exchanger means and said valve means at the hot end of each of said heat exchanger assemblies.

4. A method according to claim 1 wherein the flow of gas in step (b) is routed through a separate conduit bypassing the heated heat exchanger means of said first heat exchanger assembly and the flow of gas in step (d) is routed through a separate conduit by-passing the heated heat exchanger means of said second heat exchanger assembly.

5. A method according to claim 1 wherein regenerator means are serially interposed between the heated heat exchanger means and the valve at the hot end of said heat exchanger assemblies and wherein the flow of gas in step (b) and the flow of gas in step (d) is routed through separate conduits by-passing both the regenerators and the heated heat exchanger means.

6. A closed cycle hot gas engine comprising a cylinder accommodating a double-acting reciprocating piston means, at least two heat exchanger assemblies, each comprising heated heat exchanger means and cooled heat exchanger means serially arranged, each said heat exchanger assembly connected at one end thereof to valve means into said cylinder on one side of said piston and connected at the other end thereof through valve means into said cylinder on the other side of said piston, with the hot end of each such heat exchanger assembly connected to said cylinder on the same side of said piston, means for timing the opening and closing of said valves in relation to the movement of said piston and means for storing kinetic energy of said piston and returning that energy to said piston during the reciprocating cycle.

7. An engine according to claim 6 wherein regenerator means are serially interposed between the heated heat exchanger means and the cooled heat exchanger means in each said heat exchanger assembly.

8. An engine according to claim 6 incorporating a conduit by-passing the heated heat exchanger means of each heat exchanger assembly and incorporating a valve means in each such conduit.

9. An engine according to claim 6 wherein regenerator means are serially interposed between said heated heat exchanger means and said valve means at the hot end of each heat exchanger assembly.

10. An engine according to claim 7 wherein additional regenerator means are serially interposed between the heated heat exchanger means and the valve means at the hot end of each heat exchanger assembly and incorporating a conduit by-passing the heated exchanger means and the additional regenerator means of each heat exchanger assembly and incorporating a valve means in each such conduit.

11. A method of operating a heat pump comprising a cylinder having one end thereof connected to the other end thereof through at least two separate closed heat exchanger assemblies, each comprising heat-absorbing heat exchanger means and heat-releasing heat exchanger means serially arranged, each said closed heat exchanger assembly equipped with valve means at each end thereof; said cylinder accommodating a double-acting reciprocating piston means; said piston means cyclically displacing and being displaced by a volume of gas for each such heat exchanger assembly, said volumes of gas being alternately confined in and released from said closed heat exchanger assemblies by said valves, comprising steps of:

(a) with said piston essentially at the end of its travel toward the end of said cylinder communicating through valve means to the heat-absorbing heat exchanger means, with both valve means in the first heat exchanger assembly means in open position and both valve means in the second heat exchanger assembly in closed position and with a first volume of gas disposed within said first heat exchanger assembly and within said cylinder, and with a second volume of gas compressed in said second heat exchanger assembly and with an additional volume of gas compressed in each additional heat exchanger assembly, if any, closing said valve means at the heat-absorbing end of said first heat exchanger assembly and essentially simultaneously opening said valve means at the heat-absorbing end of said second heat exchanger assembly, expanding said second volume of gas into said cylinder against the first side of said piston while simultaneously compressing and expelling from said cylinder on the second side of said piston said first volume of gas through valve means at the heat-releasing end of said first heat exchanger assembly into said first heat exchanger assembly;

(b) with said piston essentially at the end of its travel toward the end of said cylinder communicating with said valve means to the heat-releasing ends of said heat exchanger assemblies, closing said valve means at the heat-releasing end of said first heat exchanger assembly and essentially simultaneously opening said valve means at the heat-releasing end of said second heat exchanger assembly, expelling said second volume of gas from said cylinder on said first side of said piston through said second heat exchanger assembly into said cylinder on said second side of said piston while simultaneously retaining said first volume of gas compressed in said first heat exchanger assembly;

(c) with said piston essentially at the end of its travel toward the end of said cylinder communicating with said valve means to the heat-absorbing end of said heat exchanger assembly, closing said valve means at the heat-absorbing end of said second heat exchanger assembly and essentially simultaneously opening said valve means at said heat-absorbing end of another heat exchanger assembly, which, in the case of a heat pump equipped with only two heat exchanger assemblies, will be said first heat exchanger assembly, expanding said other volume of gas into said cylinder through said valve at the heat-absorbing end of said other heat exchanger assembly against the first side of said piston while simultaneously compressing and expelling from said cylinder on the second side of said piston said second volume of gas through said valve means at the heat-releasing end of said second heat exchanger assembly into said second heat exchanger assembly;

(d) with said piston essentially at the end of its travel toward the end of said cylinder communicating with said valve means to the heat-releasing end of said heat exchanger assembly, closing said valve means at said heat-releasing end of said second heat exchanger assembly and essentially simultaneously opening said valve means at the heat-releasing end of said other heat exchanger assembly, expelling said other volume of gas from said cylinder on said first side of said piston through said other heat exchanger assembly into said cylinder on said second side of said piston while simultaneously retaining said second volume of gas compressed in said second heat exchanger assembly;

(e) repeating the cycle described in steps c. and d., treating the heat exchanger assembly from which gas has most recently been expelled into the cylinder as the second heat exchanger assembly and the next heater exchanger assembly in sequence as the other heat exchanger in a continuous repetition.

12. A method according to claim 11 wherein regenerator means are serially interposed between the heat-absorbing heat exchanger means and the heat-releasing heat exchanger means in each of said heat exchanger assemblies.

13. A method according to claim 11 wherein regenerator means are serially interposed between the heat-absorbing heat exchanger means and the valve means at the heat-absorbing end of each heat exchanger assembly.

14. A method according to claim 11 wherein the flow of gas in step (b) is routed through a separate conduit bypassing the heat-absorbing heat exchanger means of said first heat exchanger assembly and the flow of gas in step (d) is routed through a separate conduit by-passing the heat-absorbing heat exchanger means of said second heat exchanger assembly.

15. A method according to claim 12 wherein additional regenerator means are serially interposed between the heated heat exchanger means and the valve means at the heat-absorbing end of each heat exchanger assembly and wherein the flow of gas in step (b) and the flow of gas in step (d) is routed through a separate valved conduit by-passing both said additional regenerator means and the heat-absorbing heat exchange means.

16. A closed cycle heat pump comprising a cylinder accommodating a double-acting reciprocating piston means, at least two heat exchanger assemblies each comprising heat-absorbing heat exchanger means and heat-releasing heat exchanger means serially arranged, each said heat exchanger assembly connected at one end thereof through valve means into said cylinder on one side of said piston and connected at the other end thereof through valve means into said cylinder on the other side of said piston, with the heat-absorbing end of each such heat exchanger assembly connected to said cylinder on the same side of said piston, means for timing the opening and closing of said valves in relation to the movement of said piston and means for moving said piston with a cyclically reciprocating motion.

17. A heat pump according to claim 16 wherein regenerator means are serially interposed between the heat-absorbing heat exchanger means and the heat-releasing heat exchanger means in each said heat exchanger assembly.

18. A heat pump according to claim 16 wherein regenerator means are serially interposed between said heat-absorbing heat exchanger means and said valve means at the heat-absorbing end of each heat exchanger assembly.

19. A heat pump according to claim 16 incorporating a conduit by-passing the heat-absorbing heat exchanger means of each heat exchanger assembly and incorporating a valve means in each such conduit.

20. A heat pump according to claim 17 wherein additional regenerator means are serially interposed between the heat-absorbing heat exchanger means and the valve connecting that end of the heat-absorbing heat exchanger means to the cylinder, and incorporating a valved conduit by-passing said additional regenerator and said heat-absorbing heat exchanger means of each heat exchanger assembly.

21. In a device of the Stirling Cycle type for converting energy between heat and work having compression and expansion chambers, piston means for decreasing the volume of one of the chambers while increasing in the volume of the other chamber, heat exchanger means having a heated volume connected to the expansion chamber and a cooled volume connected to the compression chamber, and a fixed quantity of compressible gas confined for circulation through the chambers and heat exchanger means, the improvement comprising: first and second heat exchangers forming the heat exchanger means with each of the heat exchangers having heated and cooled volumes communicating with each other, and control means for communicating the heated volume of the first heat exchanger means to the expansion chamber while communicating the cooled volume of the second heat exchanger means to the compression chamber and subsequently communicating the heated volume of the second heat exchanger means to the expansion chamber while communicating the cooled volume of the first heat exchanger means to the compression chamber.

22. The improved device of claim 21 in which the control means includes valve means connected between the chambers and the heat exchanger means dividing the fixed quantity of gas into two separate parts with the parts communicating alternately with each of the chambers.

23. The improved device of claim 21 characterized further by the inclusion of separate inlet and outlet valve means connecting the expansion chamber to each of the heated volumes of the heat exchangers with the outlet valve communicating with the heat exchanger between the heated and cooled volumes.

24. The improved device of claim 23 characterized further by the inclusion of a regenerator connected between the heated section of each heat exchanger and the inlet valve.

* * * * *